US008599211B2

(12) United States Patent
Hsieh et al.

(10) Patent No.: US 8,599,211 B2
(45) Date of Patent: Dec. 3, 2013

(54) RGBW DISPLAY SYSTEM AND METHOD FOR DISPLAYING IMAGES THEREOF

(75) Inventors: Pei-Lin Hsieh, Taipei County (TW); Hsiang-Tan Lin, Keelung (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 339 days.

(21) Appl. No.: 12/854,163

(22) Filed: Aug. 10, 2010

(65) Prior Publication Data

US 2011/0285738 A1 Nov. 24, 2011

(30) Foreign Application Priority Data

May 20, 2010 (TW) ..... 99116103 A

(51) Int. Cl.
*G09G 5/02* (2006.01)

(52) U.S. Cl.
USPC ..... 345/589

(58) Field of Classification Search
USPC ..... 345/589
See application file for complete search history.

(56) References Cited

U.S. PATENT DOCUMENTS

| | | | | |
|---|---|---|---|---|
| 5,929,843 | A * | 7/1999 | Tanioka | 345/600 |
| 5,929,893 | A | 7/1999 | Son | |
| 7,286,136 | B2 * | 10/2007 | Phan | 345/589 |
| 7,928,929 | B2 * | 4/2011 | Shishido et al. | 345/63 |
| 8,013,867 | B2 * | 9/2011 | Higgins et al. | 345/590 |
| 8,232,944 | B2 * | 7/2012 | Takada et al. | 345/88 |
| 2004/0150651 | A1 * | 8/2004 | Phan | 345/589 |
| 2004/0189657 | A1 * | 9/2004 | Ikeda et al. | 345/589 |
| 2004/0222999 | A1 * | 11/2004 | Choi et al. | 345/589 |
| 2005/0083341 | A1 * | 4/2005 | Higgins et al. | 345/590 |
| 2006/0139527 | A1 * | 6/2006 | Chang et al. | 349/114 |
| 2006/0215191 | A1 * | 9/2006 | Tanase et al. | 358/1.9 |
| 2008/0150958 | A1 * | 6/2008 | Higgins | 345/591 |
| 2008/0231577 | A1 * | 9/2008 | Lin et al. | 345/90 |
| 2009/0059078 | A1 * | 3/2009 | Kim et al. | 348/645 |
| 2009/0102769 | A1 * | 4/2009 | Kouno et al. | 345/88 |
| 2009/0213048 | A1 * | 8/2009 | Park et al. | 345/77 |
| 2010/0103187 | A1 * | 4/2010 | Linssen | 345/590 |
| 2010/0259556 | A1 * | 10/2010 | Inuzuka | 345/604 |
| 2011/0149166 | A1 * | 6/2011 | Botzas et al. | 348/649 |

FOREIGN PATENT DOCUMENTS

| | | |
|---|---|---|
| TW | 200707328 | 2/2007 |
| TW | I297483 | 6/2008 |
| TW | 201007689 | 2/2010 |
| TW | 201009803 | 3/2010 |
| TW | 201009804 | 3/2010 |
| TW | 201017640 | 5/2010 |

* cited by examiner

*Primary Examiner* — David T Welch
*Assistant Examiner* — Hoai Le
(74) *Attorney, Agent, or Firm* — Winston Hsu; Scott Margo

(57) ABSTRACT

When a signal receiving unit receives red, green, and blue sub-pixels of an RGB pixel, a chromaticity weight generation unit generates a chromaticity weight according to the lowest gray level and the highest gray level of the red, green, and blue sub-pixels of the RGB pixel. Then, a gray level generation unit generates gray levels of red, green, blue, and white sub-pixels of an RGBW pixel according to the chromaticity weight, gray levels of the red, green, and blue sub-pixels of the RGB pixel, three chromaticity correction values and the lowest gray level. A RGBW display displays the RGBW pixel according to the gray levels of the red, green, blue, and white sub-pixels of the RGBW pixel.

10 Claims, 3 Drawing Sheets

RGBW DISPLAY SYSTEM AND METHOD FOR DISPLAYING IMAGES THEREOF

BACKGROUND OF THE INVENTION

1. Field of the Invention

The present invention relates to an RGBW display system and method for displaying images thereof, and more particularly, to an RGBW display system capable of increasing luminance and keeping color saturation and method for displaying images thereof.

2. Description of the Prior Art

An RGBW display is a display which adds white light on a traditional RGB display. Because the white light does not need a color filter, the RGBW display can provide higher luminance than the traditional RGB display, and reduce power consumption of a backlight source. Compared to the RGB display, the RGBW display has two advantages: 1. the RGBW display can provide higher luminance at the same power; and 2. the power consumption of the RGBW display is lower than the RGB display for the same luminance.

The RGBW display increases luminance of images, but reduces color saturation of the images. Please refer to FIG. 1. FIG. 1 is a diagram illustrating color saturation of an RGB pixel being reduced after adding a white sub-pixel in the CIE1931 chromaticity diagram. Taking pure red light as an example, gray levels of the red, green, and blue sub-pixels are (255, 0, 0). After adding the white sub-pixel, gray levels of the red, green, blue, and white sub-pixels are (255, 0, 0, 255), so color saturation of the pure red light may shift to the left of the CIE1931 chromaticity diagram, that is to say, the color saturation of the pure red light is reduced.

SUMMARY OF THE INVENTION

An embodiment of the present invention provides a method for displaying images. The method comprises receiving red, green, and blue sub-pixels of an RGB pixel; generating a chromaticity weight according to the lowest gray level and the highest gray level of the red, green, and blue sub-pixels of the RGB pixel; generating a gray level of the white sub-pixel according to the lowest gray level of the red, green, and blue sub-pixels of the RGB pixel; generating gray levels of red, green, and blue sub-pixels of an RGBW pixel according to the chromaticity weight, gray levels of the red, green, and blue sub-pixels of the RGB pixel, three chromaticity correction values and the gray level of the white sub-pixel; and displaying the RGBW pixel on an RGBW display according to the gray levels of the red, green, blue, and white sub-pixels of the RGBW pixel.

Another embodiment of the present invention provides a display system utilizing RGBW. The display system comprises a signal receiving unit, a chromaticity weight generation unit, a gray level generation unit, and an RGBW display. The signal receiving unit is used for receiving red, green, and blue sub-pixels of an RGB pixel. The chromaticity weight generation unit is coupled to the signal receiving unit for generating a chromaticity weight according to the lowest gray level and the highest gray level of the red, green, and blue sub-pixels of the RGB pixel. The gray level generation unit is coupled to the signal receiving unit and the chromaticity weight generation unit for generating gray levels of red, green, blue, and white sub-pixels of an RGBW pixel according to the chromaticity weight, gray levels of the red, green, and blue sub-pixels of the RGB pixel, three chromaticity correction values and the lowest gray level. And the RGBW display is coupled to the gray level generation unit for displaying the RGBW pixel according to the gray levels of the red, green, blue, and white sub-pixels of the RGBW pixel.

The present invention provides a RGBW display system and method for displaying images. The RGBW display system and method for displaying images increase color saturation of a RGB pixel by a chromaticity weight before the RGB pixel mixing white light. In addition, in the present invention, each RGB pixel has a corresponding chromaticity weight, so the present invention may adjust the color saturation for the each RGB pixel. Therefore, the RGBW display system and method for displaying images are not only saving power but also keeping the color saturation of the RGBW pixel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
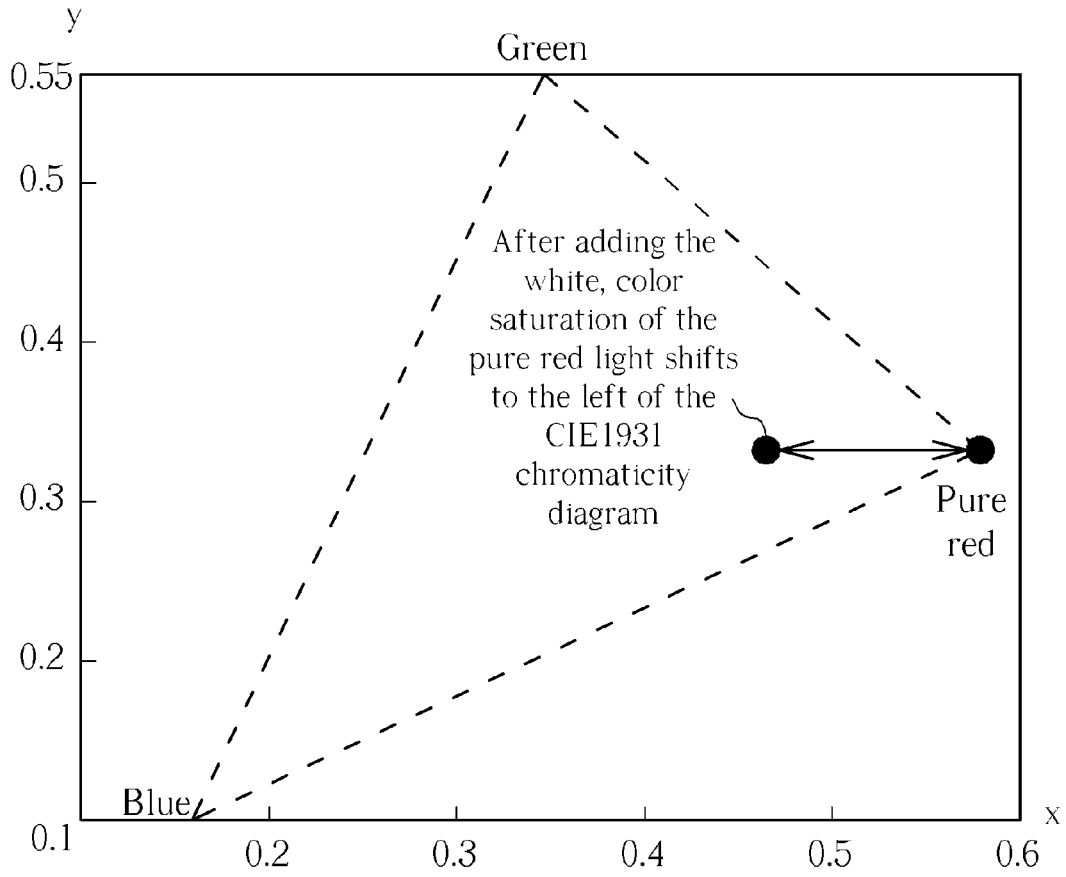
FIG. 1 PRIOR ART
FIG. 1 is a diagram illustrating color saturation of an RGB pixel being reduced after adding a white sub-pixel in the CIE1931 chromaticity diagram.
Figure 2:
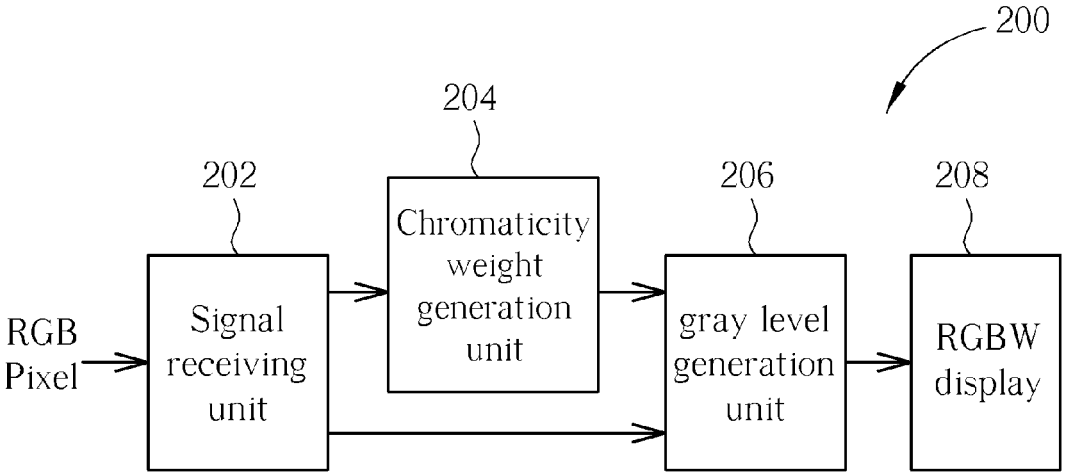
FIG. 2 is a diagram illustrating a display system utilizing RGBW according to an embodiment of the present invention.

Please refer to FIG. 2. FIG. 2 is a diagram illustrating a display system 200 utilizing RGBW according to an embodiment of the present invention. The display system 200 comprises a signal receiving unit 202, a chromaticity weight generation unit 204, a gray level generation unit 206, and an RGBW display 208. The signal receiving unit 202 is used for receiving red, green, and blue sub-pixels of an RGB pixel, where gray levels of the red, green, and blue sub-pixels are R, G, and B. The chromaticity weight generation unit 204 is coupled to the signal receiving unit 202 for generating a chromaticity weight K according to the lowest gray level Min(R,G,B) and the highest gray level Max(R,G,B) of the gray levels R, G, B of the red, green, and blue sub-pixels of the RGBW pixel. The gray level generation unit 206 is coupled to the signal receiving unit 202 and the chromaticity weight generation unit 204 for generating gray levels R0, G0, B0, W0 of red, green, blue, and white sub-pixels of an RGBW pixel according to the chromaticity weight K, the gray levels R, G, B of the red, green, blue sub-pixels of the RGBW pixel, three chromaticity correction values $\alpha$, $\beta$, $\gamma$ and the lowest gray level Min(R,G,B). The RGBW display 208 is coupled to the gray level generation unit 206 for displaying the RGBW pixel according to the gray levels R0, G0, B0, W0 of the red, green, blue, and white sub-pixels of the RGBW pixel. The RGBW display 208 is a LCD display, a plasma display, an electrophoretic display, a cathode-ray tube display, or any display using the RGBW pixel as the primary color pixel.

The chromaticity weight generation unit 204 substitutes the smallest gray level Min(R,G,B) and the biggest gray level Max(R,G,B) into equation (1) to yield the chromaticity weight K:

$$K = \frac{\mathrm{Min}(R, G, B) + \mathrm{Max}(R, G, B)}{\mathrm{Max}(R, G, B)} \quad (1)$$

The gray level generation unit 206 substitutes the chromaticity weight K, the gray levels R, G, B of the red, green, blue sub-pixels of the RGB pixel, the three chromaticity correction values α, β, γ and the smallest gray level Min(R,G,B) into equation (2) to yield the gray levels R0, G0, B0, W0 of the red, green, blue, and white sub-pixels of the RGBW pixel:

$$W0 = \mathrm{Min}(R, G, B) \quad (2)$$

$$R0 = R \times \frac{\mathrm{Min}(R, G, B) + \mathrm{Max}(R, G, B)}{\mathrm{Max}(R, G, B)} = R \times \frac{W0 + \mathrm{Max}(R, G, B)}{\mathrm{Max}(R, G, B)} - \alpha W0$$

$$G0 = R \times \frac{\mathrm{Min}(R, G, B) + \mathrm{Max}(R, G, B)}{\mathrm{Max}(R, G, B)} = G \times \frac{W0 + \mathrm{Max}(R, G, B)}{\mathrm{Max}(R, G, B)} - \beta W0$$

$$B0 = B \times \frac{\mathrm{Min}(R, G, B) + \mathrm{Max}(R, G, B)}{\mathrm{Max}(R, G, B)} = B \times \frac{W0 + \mathrm{Max}(R, G, B)}{\mathrm{Max}(R, G, B)} - \gamma W0$$

The RGBW display 208 displays the RGBW pixel according to the gray levels R0, G0, B0, W0 of the red, green, blue, and white sub-pixels of the RGBW pixel from equation (2). Besides, the three chromaticity correction values α, β, γ are constants between 0 and 2. The three chromaticity correction values α, β, γ may all be equal, may all be unequal, or two of three chromaticity correction values α, β, γ may be equal and one unequal. In the embodiment of the present invention, the three chromaticity correction values α, β, γ are set to one, so color saturation of the RGBW pixel converted from the display system 200 is the same as color saturation of the RGB pixel, and the RGBW display 208 has higher luminance than a traditional RGB display. However, the present invention is not limited to the three chromaticity correction values α, β, γ all being one.

Figure 3:
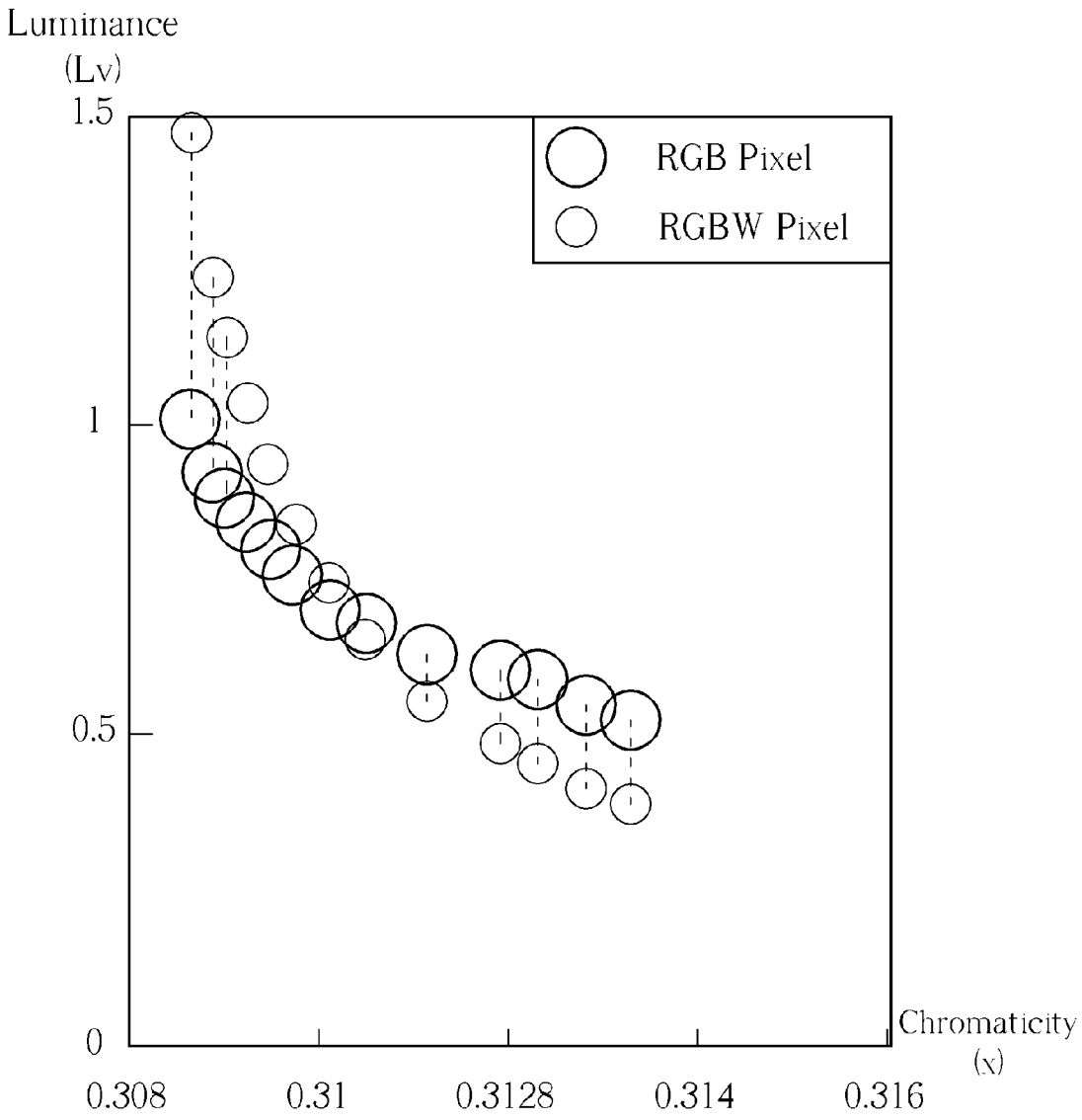
FIG. 3 is a diagram illustrating a corresponding relationship of chromaticity and luminance between the RGBW pixel converted from the display system and the RGB pixel in the CIE1931 chromaticity diagram.

Please refer to FIG. 3. FIG. 3 is a diagram illustrating a corresponding relationship of chromaticity (x) and luminance (Lv) between the RGBW pixel converted from the display system 200 and the RGB pixel in the CIE1931 chromaticity diagram. As shown in FIG. 3, taking pure green changing to white as an example, the luminance of the RGBW pixel converted from the display system 200 is slightly lower than the luminance of the RGB pixel in the pure green, but the luminance of the RGBW pixel converted from the display system 200 increases rapidly from intermediate colors to white. Taking the pure green as an example, a gray level of the RGB pixel is (0, 255, 0), but a gray level of the RGBW pixel converted from the display system 200 is (0, 255, 0, 0). Therefore, in pure color, the luminance of the RGBW pixel is slightly lower than the luminance of the RGB pixel, but the color saturation of the RGBW pixel is the same as the color saturation of the RGB pixel. In addition, the luminance of the RGBW pixel is greater than the luminance of the RGB pixel from intermediate colors to white. The above condition may also be seen in another color.

Figure 4:
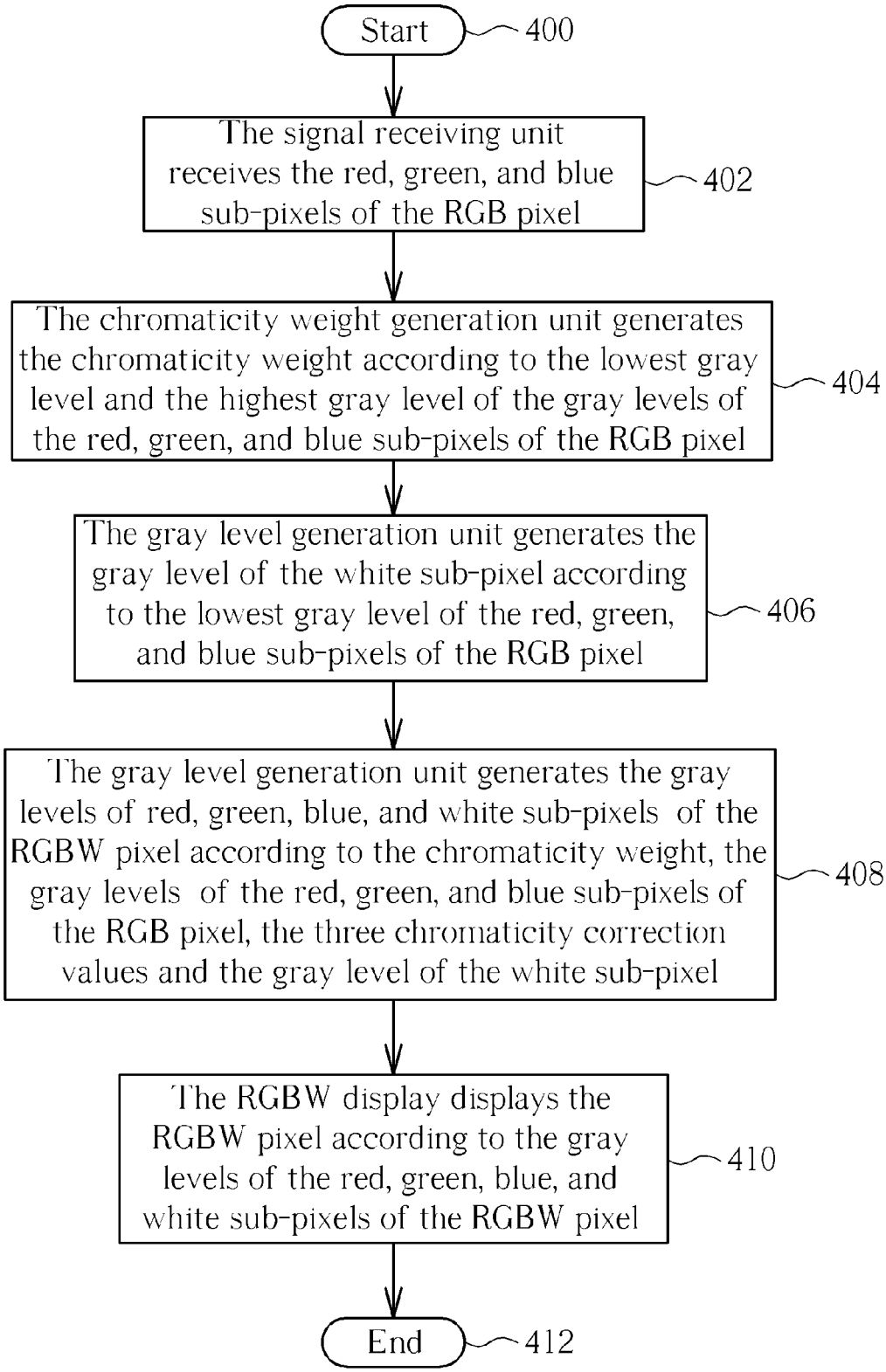
FIG. 4 is a flowchart illustrating a method for displaying images according to another embodiment of the present invention.

Please refer to FIG. 4. FIG. 4 is a flowchart illustrating a method for displaying images according to another embodiment of the present invention. FIG. 4 uses the display system 200 in FIG. 2 to illustrate the method. Detailed steps are as follows:

Step 400: Start.

Step 402: The signal receiving unit 202 receives the red, green, and blue sub-pixels of the RGB pixel, where the gray levels of the red, green, and blue sub-pixels are R, G, and B.

Step 404: The chromaticity weight generation unit 204 generates the chromaticity weight K according to the lowest gray level Min(R,G,B) and the highest gray level Max(R,G,B) of the gray levels R, G, B of the red, green, and blue sub-pixels of the RGB pixel.

Step 406: The gray level generation unit 206 generates the gray level W0 of the white sub-pixel according to the lowest gray level Min(R,G,B) of the red, green, and blue sub-pixels of the RGB pixel.

Step 408: The gray level generation unit 206 generates the gray levels of red, green, blue, and white sub-pixels R0, G0, B0, W0 of the RGBW pixel according to the chromaticity weight K, the gray levels R, G, B of the red, green, and blue sub-pixels of the RGB pixel, the three chromaticity correction values α, β, γ and the gray level of the white sub-pixel W0.

Step 410: The RGBW display 208 displays the RGBW pixel according to the gray levels R0, G0, B0, W0 of the red, green, blue, and white sub-pixels of the RGBW pixel.

Step 412: End.

To sum up, the RGBW display system and method for displaying images provided by the present invention increase the color saturation of the RGB pixel by the chromaticity weight K before the RGB pixel mixes with white (Min(R,G,B)). Compared to the prior art, the present invention provides the best gray level of white without losing color saturation. In the embodiment of the present invention, the three chromaticity correction values α, β, γ are set to one, so the color saturation of the RGBW pixel converted by the embodiment of the present invention is the same as the original color saturation of the RGB pixel. In addition, each RGB pixel has a corresponding chromaticity weight K, so the present invention may adjust the color saturation for each RGB pixel. Although the present invention may lose some luminance of the RGBW pixel in pure colors, the luminance of the RGBW pixel increases rapidly from intermediate colors to white. Generally speaking, the majority of colors of natural images are intermediate colors, so the average luminance of the RGBW pixel is increased. Therefore, compared to the prior art, the RGBW display system and method for displaying images thereof provided by the present invention not only save power, but also keep the color saturation of the RGBW pixel.

Those skilled in the art will readily observe that numerous modifications and alterations of the device and method may be made while retaining the teachings of the invention.

What is claimed is:

1. A method for displaying images, comprising:

receiving red, green, and blue sub-pixels of an RGB pixel;

generating a chromaticity weight according to a lowest gray level, and a highest gray level of the red, green, and blue sub-pixels of the RGB pixel, and the following equation:

$$K = \frac{\mathrm{Min}(R, G, B) + \mathrm{Max}(R, G, B)}{\mathrm{Max}(R, G, B)};$$

wherein

K is the chromaticity weight;

R, G, and B are the gray levels of the red, green, and blue sub-pixels of the RGB pixel;

Min(R,G,B) is the lowest gray level; and

Max(R,G,B) is the highest gray level;

generating a gray level of a white sub-pixel according to the lowest gray level of the red, green, and blue sub-pixels of the RGB pixel;

generating gray levels of red, green, and blue sub-pixels of an RGBW pixel according to the chromaticity weight, gray levels of the red, green, and blue sub-pixels of the RGB pixel, three chromaticity correction values and the gray level of the white sub-pixel; and displaying the RGBW pixel on an RGBW display according to the gray levels of the red, green, blue, and white sub-pixels of the RGBW pixel.

2. The method of claim 1, wherein generating the gray level of the white sub-pixel according to the lowest gray level of the red, green, and blue sub-pixels of the RGB pixel is utilizing the lowest gray level as the gray level of the white sub-pixel.

3. The method of claim 1, wherein generating the gray levels of the red, green, and blue sub-pixels of the RGBW pixel according to the chromaticity weight, the gray levels of the red, green, and blue sub-pixels of the RGB pixel, the three chromaticity correction values and the gray level of the white sub-pixel is performed according to the following equations:

$$R_0=R\times K-\alpha W_0;$$

$$G_0=G\times K-\beta W_0;$$

$$B_0=B\times K-\gamma W_0;$$

wherein

R, G, B are the gray levels of the red, green, and blue sub-pixels of the RGB pixel;

$R_0$, $G_0$, $B_0$ are the gray levels of the red, green, and blue sub-pixels of the RGBW pixel;

α, β, γ are the three chromaticity correction values; and $W_0$ is the gray level of the white sub-pixel.

4. A display system utilizing RGBW, comprising:

a signal receiving unit for receiving red, green, and blue sub-pixels of an RGB pixel;

a chromaticity weight generation unit coupled to the signal receiving unit for generating a chromaticity weight according to a lowest gray level, a highest gray level of the red, green, and blue sub-pixels of the RGB pixel, and the following equation:

$$K=\frac{\mathrm{Min}(R,G,B)+\mathrm{Max}(R,G,B)}{\mathrm{Max}(R,G,B)};$$

wherein

K is the chromaticity weight;

R, G, B are the gray levels of the red, green, and blue sub-pixels of the RGB pixel;

Min(R,G,B) is the lowest gray level; and

Max(R,G,B) is the highest gray level;

a gray level generation unit coupled to the signal receiving unit and the chromaticity weight generation unit for generating gray levels of red, green, blue, and white sub-pixels of an RGBW pixel according to the chromaticity weight, gray levels of the red, green, and blue sub-pixels of the RGB pixel, three chromaticity correction values and the lowest gray level; and an RGBW display coupled to the gray level generation unit for displaying the RGBW pixel according to the gray levels of the red, green, blue, and white sub-pixels of the RGBW pixel.

5. The display system of claim 4, wherein the gray level generation unit generating the gray level of the white sub-pixel according to the lowest gray level is utilizing the lowest gray level as the gray level of the white sub-pixel.

6. The display system of claim 4, wherein the gray level generation unit generating the gray levels of red, green, blue, and white sub-pixels of the RGBW pixel according to the chromaticity weight, the gray levels of the red, green, and blue sub-pixels of the RGB pixel, the three chromaticity correction values and the lowest gray level is performed according to the following equations:

$$R_0=R\times K-\alpha W_0;$$

$$G_0=G\times K-\beta W_0;$$

$$B_0=B\times K-\gamma W_0;$$

wherein

R, G, B are the gray levels of the red, green, and blue sub-pixels of the RGB pixel;

$R_0$, $G_0$, $B_0$ are the gray levels of the red, green, and blue sub-pixels of the RGBW pixel;

α, β, γ are the three chromaticity correction values; and $W_0$ is the gray level of the white sub-pixel.

7. The display system of claim 4, wherein the RGBW display is an LCD display.

8. The display system of claim 4, wherein the RGBW display is a plasma display.

9. The display system of claim 4, wherein the RGBW display is an electrophoretic display.

10. The display system of claim 4, wherein the RGBW display is a cathode-ray tube display.

* * * * *